United States Patent [19]

Kinlaw

[11] 4,064,666

[45] Dec. 27, 1977

[54] CONDENSATE ABSORPTION AND EVAPORATION ASSEMBLY

[75] Inventor: Joe C. Kinlaw, Dallas, Tex.

[73] Assignee: WindoWik Co., Dallas, Tex.

[21] Appl. No.: 712,521

[22] Filed: Aug. 10, 1976

[51] Int. Cl.[2] ..... E06B 7/12

[52] U.S. Cl. ..... 52/171; 52/209

[58] Field of Search ..... 52/171, 172, 209, 97, 52/169.14; 15/248 R; 49/408

[56] References Cited

U.S. PATENT DOCUMENTS

| | | | |
|---|---|---|---|
| 3,900,044 | 8/1975 | Seidman | 52/171 X |

FOREIGN PATENT DOCUMENTS

| | | | |
|---|---|---|---|
| 2,250,888 | 7/1975 | France | 52/209 |
| 2,252,475 | 7/1975 | France | 52/209 |
| 358,815 | 10/1931 | United Kingdom | 52/209 |

*Primary Examiner*—Price C. Faw, Jr.
*Assistant Examiner*—Carl D. Friedman
*Attorney, Agent, or Firm*—Richards, Harris & Medlock

[57] ABSTRACT

A condensate absorption and evaporation assembly having a trough-shaped non-corrosive metal frame supporting a sheet of absorbent material for absorbing and drawing the condensate by capillary attraction throughout the sheet of absorbent material. The sheet of absorbent material aids in the evaporation of the condensate by dispersing it throughout the surface area of the material.

16 Claims, 5 Drawing Figures

CONDENSATE ABSORPTION AND EVAPORATION ASSEMBLY

FIELD OF THE INVENTION

This invention relates to an apparatus for absorbing and evaporating condensate collecting on the interior surfaces of a building, and more particularly relates to a trough-shaped frame member holding a sheet of absorbent material which absorbs the condensate and disperses it by capillary attraction throughout a substantial portion of its surface area for evaporating the condensate.

DESCRIPTION OF THE PRIOR ART

Water vapor normally present in a gaseous state within a room of a building forms as condensation upon the interior surfaces of a room having a surface temperature sufficiently cool to allow the vapor to appear in its liquid state. Such condensation appears most often in the interior of buildings during the winter months when the warm, moist air inside the building strikes the colder glass surfaces of windows and doors chilled by the outside air. The condensate forming on the glass surfaces of windows and doors accumulates on the interior surface of the glass and then flows downward under the action of gravity onto the window sill.

Another frequent size of condensation in the interior of buildings is the cool metal surfaces of air conditioning unit, such as the outlet vents for the cool air. When the warmer moisture laden air in the room contacts the surrounding metal frame, the water vapor condenses on the cooler surface and accumulates to flow down the metal surface under the action of gravity. The metal surfaces of a window air conditioner unit or the outlet vent of a central air conditioning unit in a wall are two common sites for condensation forming in this manner.

Condensation forming in the interior of buildings can cause extensive property damage. The condensation accumulating on the glass surfaces of a window flows down upon the window sill, running off onto the paint or wall paper below and finally onto the flooring, such as wood or carpet. The condensate often comes in contact with curtains or draperies covering a window, causing staining and mildew. Draperies, carpet window frames and wall coverings require costly repair or replacement when damaged by condensation.

It has been known in the prior art that it would be advantageous to channel the flow of condensate formed on the interior surfaces of a building to dispose of it in such a manner as to eliminate water damage. The prior art attempts to handle the accumulation of condensation have included a variety of devices intended to channel the flow of water at the base of a window to either an opening in the building's wall leading to the outside or to a suitable container or reservoir inside for later disposal. Another approach has been to protect some of the property frequently damaged, such as draperies, with a water proofing material, such as a plastic lining to prevent the draperies from coming in contact with the condensation.

One such prior art device for protecting drapes and carpets from condensate by channeling the flow of water is described in U.S. Pat. No. 396,327, issued Jan. 15, 1889. Such a device included a flat wooden board mounted on a window sill, having channels formed in the board which deepen toward an end of the board having a hole for the condensate to flow into a detachable receptacle, such as a small metal can. This device required periodic attention to discharge the accumulated condensation within the receptacle.

Another such device for disposing of condensation by the channeling of the accumulated water is disclosed in U.S. Pat. No. 806,105, issued Dec. 5, 1905. Such a device includes ventilation openings above and below the window to generally equalize the interior and exterior temperature of the window to prevent the formation of condensation. It also included a gutter at the base of the ventilator for collecting any condensation formed on the window. The accumulated condensation was then channeled through an opening to the exterior of the building. However, such device having an opening formed to the exterior of the building for discharging the condensate also allowed rain or cold air to enter the interior of the building from the same opening.

Other devices showing an arrangement of gutters or passageways for channeling a flow of condensate from a window to another area for disposal are shown in U.S. Pat. No. 852,450, issued May 7, 1907; U.S. Pat. No. 1,196,868, issued Sept. 5, 1916; U.S. Pat. No. 2,705,819, issued Apr. 12, 1955; U.S. Pat. No. 2,869,185, issued Jan. 20, 1959; U.S. Pat. No. 3,638,372, issued Feb. 1, 1972.

A need has thus arisen for an apparatus for effectively handling the flow of condensate on the interior surfaces of a building which does not require draining the condensate through a passageway to the exterior of the building or into an accumulator which requires periodic attention. In addition, there is a need for a condensate absorption and evaporation assembly to effectively dispose of a flow of condensation from other surfaces, such as glass patio doors and air conditioning outlet vents.

SUMMARY OF THE INVENTION

The present invention provides a condensate absorption and evaporation assembly which is easily fitted to a variety of interior surfaces where condensate accumulates to effectively dispose of the flow of condensate and thereby prevent water damage to the adjacent property.

In accordance with one embodiment of the present invention, a trough shaped member having a generally L-shaped cross-sectional area is positioned with a base portion on top of a window sill, or the like, projecting from a surface having an accumulation of condensation. The base member may be attached to the window sill or like surface with a bead of caulking compound to provide a water tight seal. An upper frame support member extends to a flange to provide means for positioning a thin sheet of absorbent material over the interior surface of the frame member. The edge of the absorbent material extends from under the flange of the upper member to the edge of the base member of the L-shaped frame member, thereby abutting against the surface having the accumulation of condensation. The condensate absorbed by the absorbent material at the edge of the base member is drawn upwards through the capillary attraction of the material for the condensate, thereby dispersing the condensate over a substantial portion of the surface area of the sheet of absorbent material to promote evaporation of the condensate.

In accordance with another aspect of the invention, the trough-shaped frame member has a generally J-shaped cross-sectional area having a substantially planar base member integrally connected to curved upper member with a flange formed on the end thereof. The interior surface of the J-shaped frame member supports a sheet of absorbent material extending from under the flange to the junction point of the upper and base members. The exterior surface of the base member is affixed directly to the base of the surface having an accumulation of condensation, or substantially parallel to such a surface. As described above, water accumulating in the trough-shaped frame member is absorbed by an edge of the absorbent material and then drawn up through capillary attraction of the absorbent material for the condensate to thereby disperse the condensate over a substantial portion of the surface area of the absorbent material to promote the evaporation of such condensate.

BRIEF DESCRIPTION OF THE DRAWINGS

For a more complete understanding of the present invention and further objects and advantages thereof, reference is now made to the following description taken in conjunction with the following drawings.

DESCRIPTION OF PREFERRED EMBODIMENT

Figure 1:
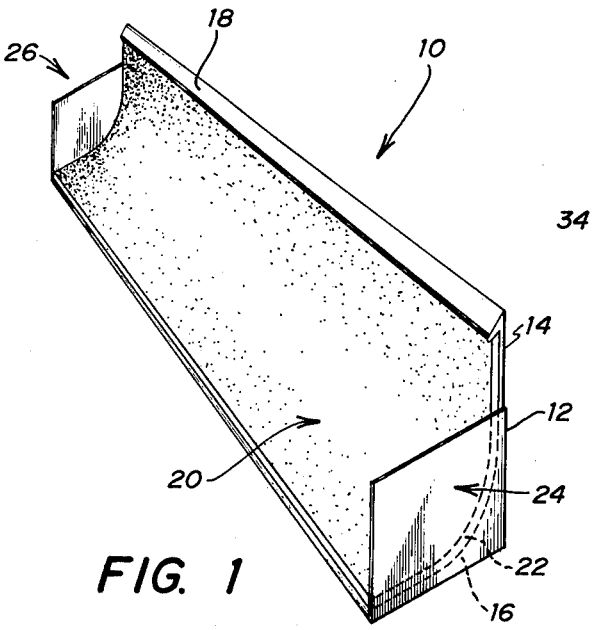
FIG. 1 is a perspective view of the preferred embodiment of the invention.

FIG. 1 shows a perspective view of the preferred embodiment of the present condensate absorption and evaporation assembly, generally identified by the numeral 10. A trough-shaped frame support member 12 includes an upper body segment 14 and a lower body segment 16. The upper body segment 14 extends to a flange member 18 for positioning thereunder a thin sheet of absorbent material 20, which rests on the interior surface 22 formed by the upper body segment 14 and lower body segment 16 and extends to the front edge of the lower segment 16. First and second end pieces 24 and 26 are formed on the opposite ends of frame member 12 forming a closed trough to completely entrain condensation received within said frame 12.

Figure 2:
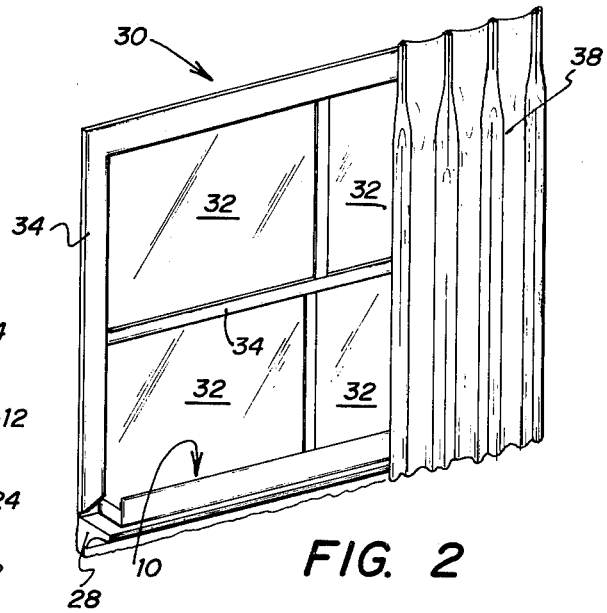
FIG. 2 is a perspective view of the preferred embodiment of the invention shown installed on a window sill.

FIG. 2 illustrates the condensate absorption and evaporation assembly 10 installed on top of window sill 28 of a window 30. The window 30 is a typical window having a number of glass panes 32 mounted in frame members 34. Frame members 34 may typically be constructed of wood or some noncorrosive metal such as aluminum. Window 30 is shown as an opening in the interior wall 36 of a building, and draperies 38 are positioned about window 30.

Figure 3:
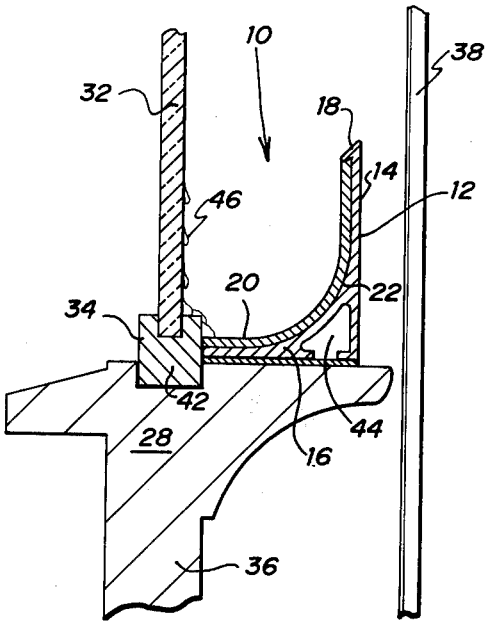
FIG. 3 is a cross-sectional side view of the preferred embodiment of the invention shown in FIG. 2.

FIG. 3 is a cross-sectional side view of the condensate absorption and evaporation assembly 10 illustrated in FIG. 2. The lower body portion 16 of the frame 12 is mounted to the upper surface of window sill 28 by a bead of caulking compound 40, whereby front edge 42 of the lower body member 16 is positioned adjacent the lower frame member 34 of the window 30. The caulking compound 42 provides a water tight seal between the frame member 12 and the window seal 28 to prevent moisture accumulating under the frame member 12. A caulking compound 42 providing such a suitable water tight seal is manufactured by the Darworth Co. and sold under the trade name Polyseamseal.

A sheet of absorbent material 20 covers substantially the entire interior surface 22 of the frame member 12, extending lengthwise between the first and second end pieces 24 and 26 and widthwise between flange 18 and front edge 42 of the lower member 16. After installation of the frame member 12 on the window sill 28, the absorbent material 20 is then placed on the interior surface area 22 and held by the slight lateral pressure caused by the flange 18 and the frame member 34.

The frame member 12 may be formed by extruding a piece of non-corrosive metal, such as aluminum, to achieve the desired dimensions. The hollow segment 44 is formed between the upper segment 14 and lower segment 16 during the extrusion process to affect a savings in the material used. The frame member 12 may take on any number of shapes which will adequately support and position the absorbent material 20.

When the interior surface temperature of the glass 32 is lowered by the outside air temperature to a point where the water vapor in the interior of the room forms as condensate 46, the condensate 46 continues to accumulate on the interior surface of glass 32 and eventually flows under the action of gravity to the lower frame member 34 and then onto window sill 38. However, upon installation of condensate absorption and evaporation assembly 10, the flow of condensate 46 is absorbed by the leading edge of the absorbent material 20 abutting the lower frame member 34, and then drawn by capillary attraction to the upper portions of the absorbent material 20, thereby giving a greater surface area over which the condensate 46 may be evaporated. In addition, the upper member 14 to the frame member 12 acts as a shield to prevent the drapery 38 from contacting the flow of condensate 46 upon the glass pane 32. Thus, the absorption and evaporation assembly 10 prevents the condensate 46 from causing water damage to the window sill 28, the interior surface of wall 36, the draperies 38, or the flooring of the room.

Figure 4:
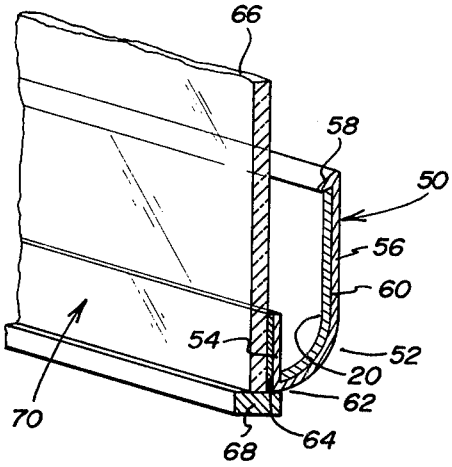
FIG. 4 is a partially cut away perspective view of an alternate embodiment of the invention shown installed on a patio door.

FIG. 4 illustrates an alternate embodiment of the condensate absorption and evaporation assembly, generally identified by the numeral 50. A trough-shaped frame member 52 having a generally J-shaped cross-sectional area includes a first lower segment 54 integrally connected to an upper segment 56 extending to a flange 58 formed on the end thereof. The absorbent material 20 is supported along the inner surface 60 of the upper member 56 and extends between the flange 58 and a point 52 where the lower segment 54 joins the upper segment 56. The condensate absorption assembly unit 50 may have end pieces formed on opposite ends as shown and described in FIG. 5 below.

The alternate embodiment 50 has the exterior surface of its lower member 54 affixed directly to a surface having a flow of condensate by means of a water tight double adhesive tape 64. The double adhesive tape 64 should provide a water tight seal between the surface having the flow of condensate and the lower member 54. A suitable water tight double adhesive tape 64 is manufactured by the Minnesota Mining and Manufacturing Company and sold under the trade name Varistraite.

The condensate absorption assembly unit 50 is shown attached to the pane of glass 66 supported in a runner 68 of a patio door 70. The upper member 56 is dimensioned to extend only a relatively short distance from the inner face of glass surface 66, so that the patio door 70 may slide freely past one another with the condensate absorption assembly unit 50 attached directly to the inner face of the patio door 70.

The exterior surface of the upper member 56 acts as a shield to prevent drapes from contacting the condensate on the inner surface of glass pane 66, while the absorbent material 20 operates in the manner described above for the condensate absorption and evaporation assembly 10 by drawing the water entrained in the trough of the frame member 52 by capillary action throughout the surface area of the absorbent material 20 to aid in the evaporation of the condensate.

Another important advantage of the alternate embodiment 50 is to provide a condensate absorption and assembly unit that may be affixed directly to individual window panes 32 of a window 30, shown in FIG. 2. Thus, for example, the individual window panes 32 and a window 30 might each have an individual condensate absorption and evaporation assembly 50 mounted directly on the bottom edge of the interior surface of glass pane 32 held by a frame member 34.

Figure 5:
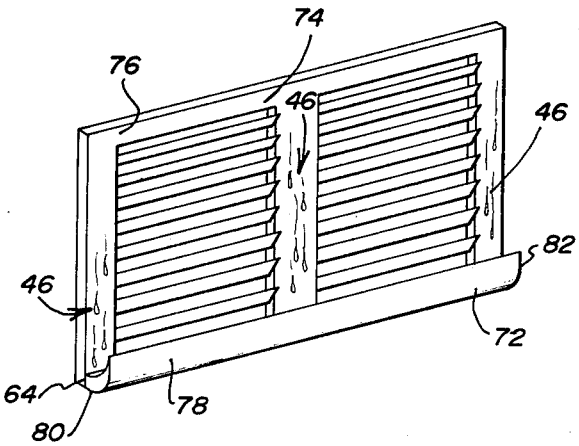
FIG. 5 is a perspective view of an alternate embodiment of the invention installed on the outlet vent of an air conditioning duct.

FIG. 5 illustrates an alternate embodiment of a condensate absorption and evaporation assembly 72 affixed by means of a double adhesive tape 64 to the interior surface 74 of an air conditioning outlet 76, thereby forming a water tight seal between the air conditioning duct 76 and the condensate absorption and evaporation assembly 72. Condensate absorption and evaporation assembly 72 is configured substantially similar to the absorption and evaporation unit 50, but has a greater radius of curvature for the frame member 78 to provide a larger interior surface area for the absorbent material 20. The assembly 72 has end pieces 80 and 82 on opposite ends thereof to collect and drain all condensate 46 flowing into the subjacent assembly 72.

It will be understood that the frame members of the condensate absorption and evaporation assembly may be constructed from any suitable material, but preferably extruded from a non-corrosive metal, such as aluminum. The absorbent material 20 may consist of any material having a capillary attraction for water, including natural or synthetic fibers or blends of natural or synthetic fibers. One such synthetic fiber which has been found to be suited for such a use is a sheet of 100 percent rayon having an open weave construction. Numerous other absorbent materials may be used, including a sheet of spongelike material.

All of the preferred embodiments of the invention have been illustrated in the accompanying drawings and described in the foregoing description. It will be understood that the invention is not limited to the embodiments disclosed, but are capable of numerous rearrangements, modifications, and substitution of parts and elements without departing from the spirit of the invention.

What is claimed is:

1. A condensate absorption and evaporation assembly comprising:

a trough-shaped frame member disposed subjacent a surface having a flow of condensate, said frame member extending only along that side of the surface having the flow of condensate;

a sheet of absorbent material supported by said frame member, whereby condensate flowing into said frame member is entrained within said frame member and absorbed by and carried upward through the capillary attraction of said absorbent material for the condensate to promote the evaporation of the condensate.

2. The condensate absorption and evaporation assembly of claim 1, wherein said trough-shaped frame member has a generally L-shaped cross-sectional area and said frame member includes a first and second end piece formed on opposite ends of said frame member to thereby form a closed trough for entraining a flow of condensate.

3. A condensate absorption and evaporation assembly of claim 2, wherein said L-shaped frame member includes an upper portion extending to a flange member, said sheet of absorbent material being positioned upon the interior surface of said L-shaped frame member, and being adjacent said flange member.

4. The condensate absorption and evaportion assembly of claim 2, wherein said L-shaped frame member has a base portion for attachment to a surface projecting from and subjacent to a surface having a flow of condensate.

5. The condensate absorption and evaporation assembly of claim 1, wherein said trough-shaped frame member has generally J-shaped cross-sectional area and said frame member further includes a first and second end piece formed on opposite ends thereof to thereby form a closed trough for entraining a flow of condensate.

6. The condensate absorption and evaporation assembly of claim 5, wherein an upper segment of said J-shaped frame member extends to a flange portion, said sheet of absorbent material being supported upon the interior surface of said frame member and extends adjacent to said flange.

7. The condensate absorption and evaporation assembly of claim 5, wherein said J-shaped frame member has a base portion for attachment subjacent to a surface having a flow of condensate.

8. The condensate absorption and evaporation assembly of claim 1, wherein said frame member is aluminum.

9. The condensate absorption and evaporation assembly of claim 1, wherein said absorbent material is rayon.

10. A condensate absorption and evaporation assembly comprising:

a trough-shaped non-corrosive metal frame member having end pieces formed on opposite ends thereof, said frame member being disposed subjacent a surface having a flow of condensate, said frame member further being disposed entirely on the side of the surface having the flow of condensate;

means for affixing said frame member subjacent the surface having a flow of condensate;

a sheet of absorbent material supported upon said frame member whereby the flow of condensate is entrained within said frame member and drawn by the capillary attraction of said absorbent material over other areas of said absorbent material to promote evaporation of the condensate.

11. The condensate absorption and evaporation assembly of claim 11, wherein said trough-shaped frame member has a generally L-shaped cross-sectional area having a base portion and an upper portion.

12. The condensate absorption assembly of claim 11, wherein said L-shaped frame member is disposed subjacent a flow of condensate by affixing said base portion of said frame member to a surface extending substantially normal to a surface having a flow of condensate.

13. The condensate absorption and evaporation assembly of claim 10, wherein said trough-shaped frame member has a generally J-shaped cross-sectional area having a base portion and an upper portion.

14. The condensate absorption assembly of claim 13, wherein said J-shaped frame member is disposed subjacent a flow of condensate by affixing said base portion of said frame member below the surface having a flow of condensate.

15. A condensate absorption and evaporation assembly of claim 10, wherein said means for attaching comprises a water tight sealing compound.

16. A condensate absorption and evaporation assembly of claim 10, wherein said means for affixing comprises a strip of double adhesive tape.

* * * * *

UNITED STATES PATENT AND TRADEMARK OFFICE

CERTIFICATE OF CORRECTION

PATENT NO. : 4,064,666
DATED : December 27, 1977
INVENTOR(S) : Joe C. Kinlaw

It is certified that error appears in the above-identified patent and that said Letters Patent are hereby corrected as shown below:

Column 1, line 28 "size" should be --site--;

Column 6, line 23 --a-- should be inserted between "has" and "generally";

Column 6, line 59 "11" should be --10--.

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*